US007587146B2

(12) United States Patent
Horn

(10) Patent No.: US 7,587,146 B2
(45) Date of Patent: Sep. 8, 2009

(54) SYSTEM FOR MANAGING PAPER SUPPLIES IN A POPULATION OF PRINTERS AND COPIERS

(75) Inventor: Richard T. Horn, Claremont, CA (US)

(73) Assignee: Xerox Corporation, Norwalk, CT (US)

( * ) Notice: Subject to any disclaimer, the term of this patent is extended or adjusted under 35 U.S.C. 154(b) by 489 days.

(21) Appl. No.: 11/514,013

(22) Filed: Aug. 31, 2006

(65) Prior Publication Data

US 2008/0056738 A1 Mar. 6, 2008

(51) Int. Cl.
*G03G 15/00* (2006.01)

(52) U.S. Cl. ..... 399/16; 347/23

(58) Field of Classification Search ..... 399/16, 399/381, 393; 400/624
See application file for complete search history.

(56) References Cited

U.S. PATENT DOCUMENTS 6,647,222 B1 11/2003 Digby et al.
6,938,976 B2 * 9/2005 Siwinski et al. ..... 347/19
2003/0084178 A1 * 5/2003 Simpson et al. ..... 709/231
2005/0143073 A1 * 6/2005 Lee et al. ..... 455/436
2005/0151823 A1 * 7/2005 Botten et al. ..... 347/213
2007/0183796 A1 * 8/2007 Ueki et al. ..... 399/23

FOREIGN PATENT DOCUMENTS

JP 2002215379 A * 8/2002

* cited by examiner

*Primary Examiner*—Daniel J Colilla
*Assistant Examiner*—Allister Primo
(74) *Attorney, Agent, or Firm*—Ronald E. Prass, Jr.; Prass LLP

(57) ABSTRACT

A method of operating a printer comprising at least one tray for retaining print media comprises reading a code associated with a quantity of print media, and associating the code with loading the quantity of print media in the tray in a database. If the print media in the tray is deemed unusual, based on types of media placed in the tray in the past, a human user near the printer is notified. The code on the print media is read through a wireless device in direct communication with a server retaining the database for a population of printers.

7 Claims, 2 Drawing Sheets

SYSTEM FOR MANAGING PAPER SUPPLIES IN A POPULATION OF PRINTERS AND COPIERS

INCORPORATION BY REFERENCE

The following U.S. Patent is incorporated by reference in its entirety for the teachings therein: U.S. Pat. No. 6,647,222 B1.

TECHNICAL FIELD

The present invention relates to copiers and printers that can be operated over a network.

BACKGROUND

In the office-equipment context, such as including copiers and printers, it is generally well known to provide, with each machine, a plurality of selectable trays, each having an identifiable type of print media therein. Different types of media may typically include papers of different sizes or colors, or transparency media. With specific users, however, there may be very specific types of media, such as different types of letterhead or other user-specific forms.

In situations where a plurality of copiers and printers are in communication with various computers through a network, a user originating a print job at a computer will wish to locate a machine having a correct type of media on which to print. Where the selection of available types of media is wide, such as including specific types of letterhead, a user at a computer will wish to have this very specific information about the media in each tray of many machines displayed to him in detail.

In the prior art, the fact that machines may be widely distributed geographically, with various machines being under the control of local key operators (who are responsible for maintaining supplies in each tray), creates a danger that a description of the media that is displayed to the user may become incorrect. U.S. Pat. No. 6,647,222 B1, mentioned above, discloses one method by which media information may be entered into each of a population of machines through a local user interface associated with each machine.

The present disclosure relates to a system for ensuring that correct or usual types of media are loaded into each of a population of printers and copiers, and also for accumulating and analyzing data about the media contents in each tray of each of a population of printers.

SUMMARY

According to one aspect, there is provided a method of operating a printer, the printer comprising at least one tray for retaining print media, comprising reading a code associated with a quantity of print media; associating the code with loading the quantity of print media in the tray in a database; and determining if the quantity of print media in the tray is unusual.

According to another aspect, there is provided a method of operating a plurality of printers, each printer including at least one tray for retaining print media. A reader reads a machine-readable code associated with a quantity of print media proposed to be loaded into a selected tray of a selected printer, and at least partially wirelessly transmits data relating to the code to a server. The server associates the code with loading the quantity of print media in the tray in a database. The database includes data relating to each printer in the plurality of printers, as well as a record of types of print media loaded into the selected tray in the past. The server uses the database to determine if the loading of the quantity of print media in the tray is unusual. The server indicates to a person loading the tray with the proposed quantity of print media that the proposed quantity of print media is unusual.

DETAILED DESCRIPTION

Figure 1:
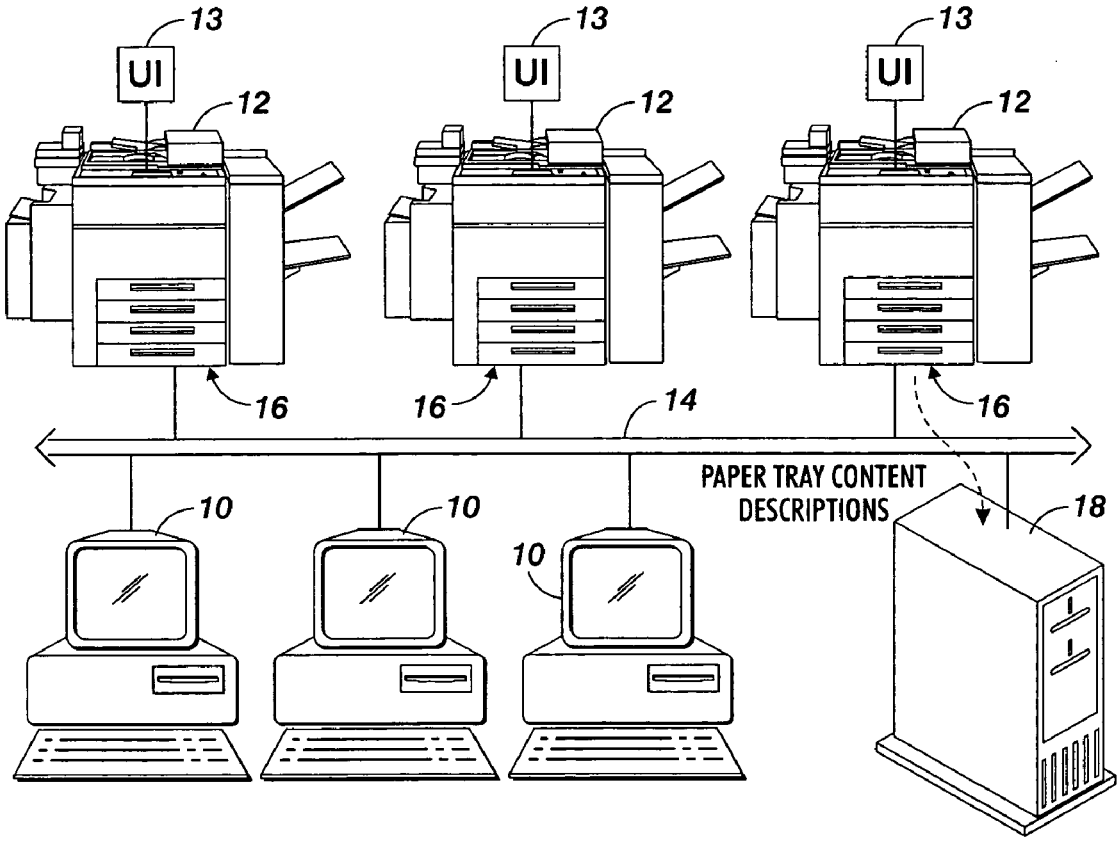
FIG. 1 is a diagram showing a network of user computers that can selectably operate one of a plurality of printers and copiers.

FIG. 1 is a diagram showing a network of user computers that can selectably operate one of a plurality of printers and copiers. (As is familiar in the art, many digital copiers and facsimile machines function as printers, in that they output images based on data originating at a computer, and so for present purposes all such machines shall be referred to as "printers.") Each user computer 10 is capable of sending print job data to a selected printer 12 over a network 14. Each printer includes a plurality of what are here called paper trays (but which can be in any physical form and can conceivably retain any kind of print media), collectively labeled 16 within each printer. Each printer can include thereon a local user interface (UI) 13, through which messages can be displayed (including sound messages) and instructions can be entered into a control system associated with the machine. Also available to all the printers on a network 14 is a server 18, which typically is accessed by a systems administrator. As used herein, a "server" is any computer that is capable of retaining and performing operations on a database relating to the printers in a given population.

Figure 2:
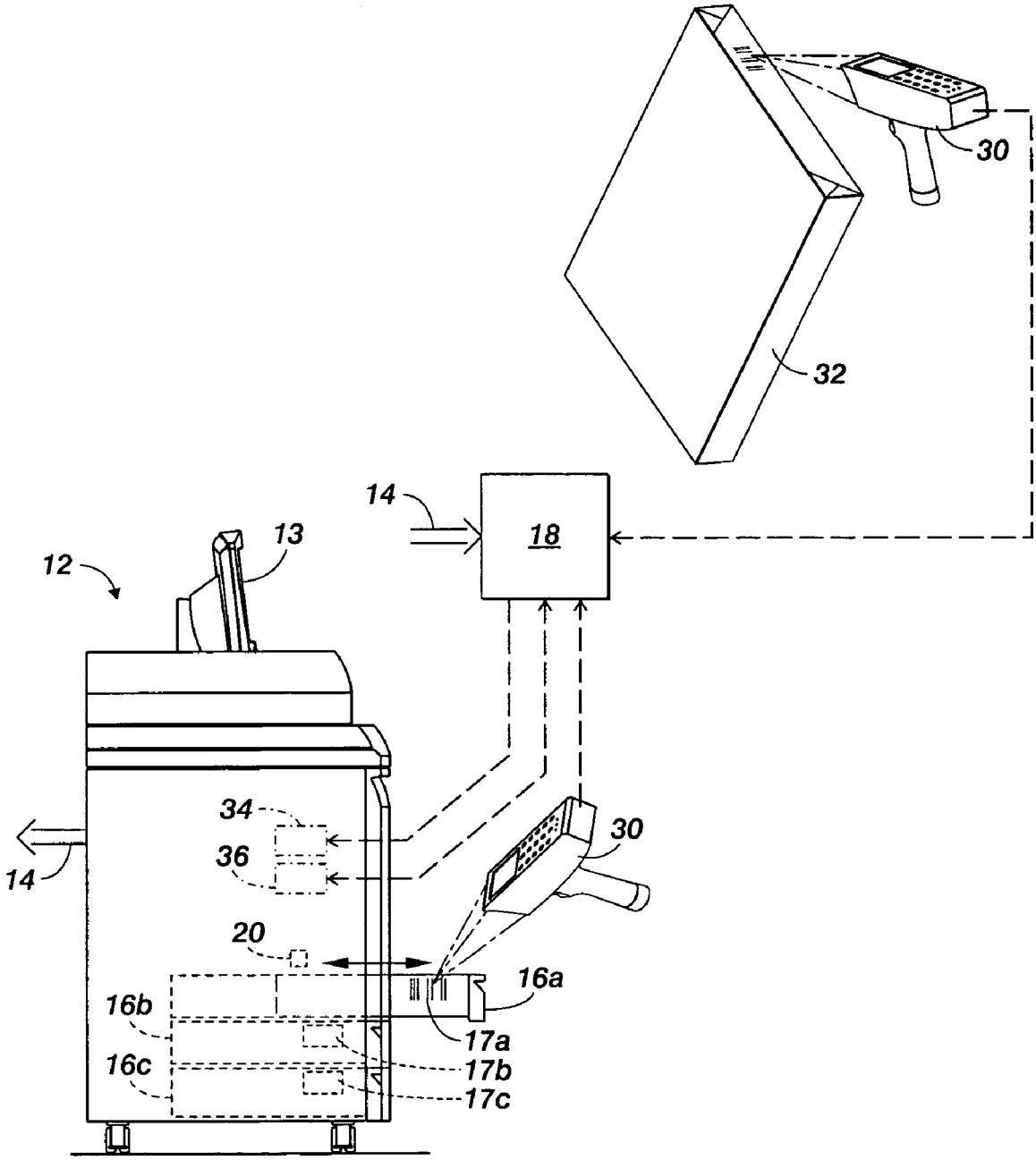
FIG. 2 is a simple diagram of a single printer, interacting with elements of a proposed embodiment.

FIG. 2 is a simple diagram of a single printer 12, interacting with elements of a proposed embodiment. The printer 12 includes three distinct trays, indicated as 16*a*, 16*b*, and 16*c*, which can accept stacks of paper (or, more broadly, "media") for feeding to the printing apparatus. There may further be provided one or more sensors such as 20 for determining the status (open for loading, or closed for feeding to the printer) of each tray 16*a*, 16*b*, and 16*c*.

In one embodiment there is a wireless reader 30 that can be carried by a person servicing a population of printers. The wireless reader 30 has at least two essential capabilities: to read machine-readable code (typically a bar-code, but any kind is possible) and wirelessly transmit data related to a code. The basic hardware platform of such a reader 30 can be a wireless bar-code scanner or a cell phone, such as with digital-camera hardware. In use, the code-reading portion of the device reads a machine-readable code associated with a quantity of media, such as on the packaging of a stack of paper 32. Data identifying the type of quantity of media is then transmitted to a central database, such as retained for a population of printers in server 18, in one of a number of ways. One way is for the reader 30 to contact server 18 through cell-phone channels; another is for the reader 30 to transmit the data through very short range radio signals to a receiver 34 on board the printer 12; the received data is then sent through network channels from printer 12 through network 14 to server 18. Other ways of getting data from reader 30 to server 18 will be apparent.

When a machine-readable code associated with a quantity of media 32 is loaded into a tray of a printer 12, the quantity of media 32 must in turn be associated in the database with a specific tray such as 16*a,* 16*b,* 16*c.* There are a number of possible approaches to accomplish this. In one method, incidental to transmitting data relating to the quantity of media 32, the reader 30 transmits data relating to the tray 16*a,* 16*b,* or 16*c* intended to receive the media. Each tray can have a machine-readable code 17*a,* 17*b,* or 17*c,* visible when the tray is open, that identifies the tray and the printer 12. When opening a tray such as 16*a* for loading, the user of reader 30 reads the code on media 32 and the code on tray 16*a* within a predetermined time-window, and then transmits data relating both codes to each other to server 18. Software associated with server 18 then identifies the media 32 with the tray 16*a.* (As shown in the Figure, two readers 30, one reading the stack of paper 32 and one reading the code 17*a,* are shown for clarity; in a practical embodiment, one reader 30 is used for both functions.)

Alternately, a user opens a particular tray such as 16*a,* thus activating sensor 20, which in turn indicates to a control system governing printer 12 that tray 16*a* is open. While the tray is open, the user uses reader 30 to read the code associated with media 32. A signal that tray 16*a* is open is sent to server 18 through network 14, and within a predetermined time window, the code for media 32 is sent to server 18 through whatever channel. Software associated with server 18 then identifies the media 32 with the tray 16*a.* There may also be ancillary data associated with the loading of the media in the tray, such as a date-time stamp and the identity of the person (identified as the holder of a particular reader 30, the reader 30 identifying itself to the database with each transmission of data) doing the loading: this ancillary data is also accumulated in the database.

Instead of using a wireless device such as 30, there may be provided, in effect "on-board" a printer 12, a code reader 36. In loading the printer 12, a user opens the desired tray such as 16*a,* indicating through sensor 20 that the tray is open, and then holds the code on media 32 to the code reader 36. Software associated with printer 12 and/or server 18 then identifies the media 32 with the tray 16*a.* In such a case, information about the date and time of the loading, as well the identity of the person doing the loading, can be entered via the UI 13 of the printer, or by other means.

Further according to this embodiment, once a quantity of media 32 is associated with a particular tray such as 16*a* in a particular printer 12 in the database in server 18, a service is provided to ensure that a "usual" type of media 32 is loaded in the tray. In practical use of large fleets of printers serviced by specialized personnel, the placement of the "wrong" type of media in a particular tray is a significant customer dissatisfier. The present disclosure thus provides an automatic check that correct or "usual" media has been loaded in a particular tray.

Within a database serving a population of printers, such as retained within a server 18, each tray of each printer is associated with at least one type of "usual" media. As used herein, "usual" means that the media has characteristics (brand, vendor, color, size, weight, finish, pre-printing, etc.) that are to some extent consistent with types of media that have been loaded into that particular tray in the recent past. The identity of types of media that have been loaded into the tray in the recent past is also retained in the database. The database may also include a table that associates each specific code, such as an SKU, as would possibly be read by reader 30 or code reader 36 with a set of characteristics. By associating each SKU with a set of characteristics, rules can be set up allowing substitutions of SKU's.

Since the database in server 18 keeps some kind of record of what type of media is "usual" for a given tray in a given printer, an algorithm is provided for deeming a media 32 proposed for loading into a particular tray to be "unusual." "Unusual" can be defined in various ways, and an algorithm will reflect the definition; e.g., if the SKU of the proposed media is at all different from the previous media loaded into the tray; if the proposed media comes from a different vendor; if the proposed media is of different color; if the proposed media is of different size; if the proposed media is of different weight; or if the proposed media is of different finish, etc.

If the algorithm determines that a media 32 proposed for loading into the tray is "unusual," a feedback of some kind to the user at the printer, or to a systems administrator associated with server 18, is initiated. Different types of feedback are possible depending on customer desires. Most simply, an "Are you sure?" pop-up can appear at the UI 13 associated with the printer 12, sending a message to the human user. A message can be sent wirelessly, from whatever source, to the reader 30, and the reader 30 could let out a sound and show a message to the user. Alternatively or in addition, the use of "unusual" media can be indicated to the systems administrator governing the population of printers, and approval from the systems administrator may be required (under penalty of, for instance, disabling the printer).

Information about media loaded into each tray in each printer over time can be retained in server 18 for statistical analysis, such as correlating with malfunctions, or flagging situations in which a particular printer 12 is overused (such as by noting a large number of reloads of a tray within a period of time). The database in server 18 can be used for re-ordering media from a vendor, facilitating asking the vendor to send more media (in proportions of sheet sizes, etc., as determined by past use) to the physical address of the particular printer.

In another embodiment, there is compiled via server 18 a master list of the descriptions of the contents of all trays in all machines accessible to any user on network 14. For various possible reasons, the "history" of what types of media have been loaded in any particular tray 16 in any printer 12 on the network in the past may be made available to any user associated with network 14.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a plurality of printers, each printer including at least one tray for retaining print media, comprising:

a reader reading a machine-readable code associated with a quantity of print media proposed to be loaded into a selected tray of a selected printer, and at least partially wirelessly transmitting data relating to the code to a server;

the server associating the code with loading the quantity of print media in the tray in a database, the database including data relating to each printer in the plurality of printers, the database including a record of types of print media loaded into the selected tray in the past;

the server using the database to determine if the loading of the quantity of print media in the tray is unusual; and the server indicating to a person loading the tray with the proposed quantity of print media that the proposed quantity of print media is unusual.

2. The method of claim 1, the indicating including transmitting a message wirelessly into the reader.

3. The method of claim 1, the indicating including transmitting a message through a user interface of the selected printer.

4. The method of claim 1, further comprising the reader reading machine readable code associated with the selected tray.

5. The method of claim 1, further comprising, detecting that the selected tray is open.

6. The method of claim 1, the associating including the server receiving information about the proposed quantity of print media and the selected tray within a predetermined time window.

7. The method of claim 1, the associating further including retaining data relating to a person loading print media in the tray.

* * * * *